US011605345B2

(12) United States Patent
Matsueda

(10) Patent No.: US 11,605,345 B2
(45) Date of Patent: Mar. 14, 2023

(54) DISPLAY DEVICE

(71) Applicant: WUHAN TIANMA MICRO-ELECTRONICS CO., LTD., Wuhan (CN)

(72) Inventor: Yojiro Matsueda, Kanagawa (JP)

(73) Assignee: WUHAN TIANMA MICRO-ELECTRONICS CO., LTD., Wuhan (CN)

( * ) Notice: Subject to any disclaimer, the term of this patent is extended or adjusted under 35 U.S.C. 154(b) by 0 days.

(21) Appl. No.: 17/539,654

(22) Filed: Dec. 1, 2021

(65) Prior Publication Data

US 2022/0208096 A1 Jun. 30, 2022

(30) Foreign Application Priority Data

Dec. 24, 2020 (JP) ..... JP2020-214496

(51) Int. Cl.
*G09G 3/3233* (2016.01)
*G09G 3/3266* (2016.01)
*G09G 3/3291* (2016.01)

(52) U.S. Cl.
CPC ..... *G09G 3/3233* (2013.01); *G09G 3/3266* (2013.01); *G09G 3/3291* (2013.01); *G09G 2310/0291* (2013.01)

(58) Field of Classification Search
CPC ... G09G 2300/0426; G09G 2300/0842; G09G 3/3266; G09G 3/3225; G09G 3/3233; G09G 3/32; G09G 3/3685; G09G 2310/0251; G09G 2310/0202; G09G 2320/0233
See application file for complete search history.

(56) References Cited

U.S. PATENT DOCUMENTS

| | | | | |
|---|---|---|---|---|
| 2008/0036706 | A1 | 2/2008 | Kitazawa | |
| 2008/0231560 | A1 | 9/2008 | Yamashita et al. | |
| 2016/0125844 | A1 * | 5/2016 | Lee | G09G 3/3233 345/213 |
| 2019/0057653 | A1 | 2/2019 | Yamashita et al. | |
| 2020/0111401 | A1 * | 4/2020 | Zhao | G09G 3/2003 |
| 2020/0235193 | A1 * | 7/2020 | Tokuda | H01L 51/50 |
| 2021/0028270 | A1 * | 1/2021 | Yokoyama | H05B 33/06 |

* cited by examiner

*Primary Examiner* — Dong Hui Liang
(74) *Attorney, Agent, or Firm* — Nixon & Vanderhye

(57) ABSTRACT

A display device includes a display region including pixel circuits, and a driver for outputting a control signal to the pixel circuits. The display region includes a first region and a second region having a lower pixel circuit density than the first region. The driver includes output buffers. Each of the output buffers simultaneously outputs the control signal to the pixel circuits. The output buffers include a first output buffer and a second output buffer. The number of the pixel circuits as output destinations of the control signal of the first output buffer is larger than the number of the pixel circuits as output destinations of the control signal of the second output buffer. A channel width of a drive transistor of the first output buffer is larger than that of a drive transistor of the second output buffer.

9 Claims, 13 Drawing Sheets

DISPLAY DEVICE

CROSS-REFERENCE TO RELATED APPLICATIONS

This non-provisional application claims priority under 35 U.S.C. § 119(a) on Patent Application No. 2020-214496 filed in Japan on Dec. 24, 2020, the entire content of which is hereby incorporated by reference.

BACKGROUND

This disclosure relates to a display device.

Since OLED (Organic Light-Emitting Diode) elements are self-luminous elements, a backlight is not required and, moreover, there are merits of achieving lower power consumption, a wide viewing angle and a high contrast ratio. Thus, the OLED elements are expected in the development of flat panel displays.

A display region of an OLED display device may include regions having different pixel densities. For example, a camera for imaging is arranged below a display region in mobile terminals such as several smartphones and tablet computers. For the light reception of the camera from outside, the camera is arranged below a region where the pixel density is smaller than surroundings.

SUMMARY

A display device according to an aspect of this disclosure includes a display region including a plurality of pixel circuits, and a driver for outputting a control signal to the plurality of pixel circuits. The display region includes a first region and a second region having a lower pixel circuit density than the first region. The driver includes a plurality of output buffers. Each of the plurality of output buffers simultaneously outputs the control signal to the plurality of pixel circuits. The plurality of output buffers include a first output buffer and a second output buffer. The number of the pixel circuits as output destinations of the control signal of the first output buffer is larger than the number of the pixel circuits as output destinations of the control signal of the second output buffer. A channel width of a drive transistor of the first output buffer is larger than that of a drive transistor of the second output buffer.

It is to be understood that both the foregoing general description and the following detailed description are exemplary and explanatory and are not restrictive of this disclosure.

DESCRIPTION OF EMBODIMENTS

Figure 1:
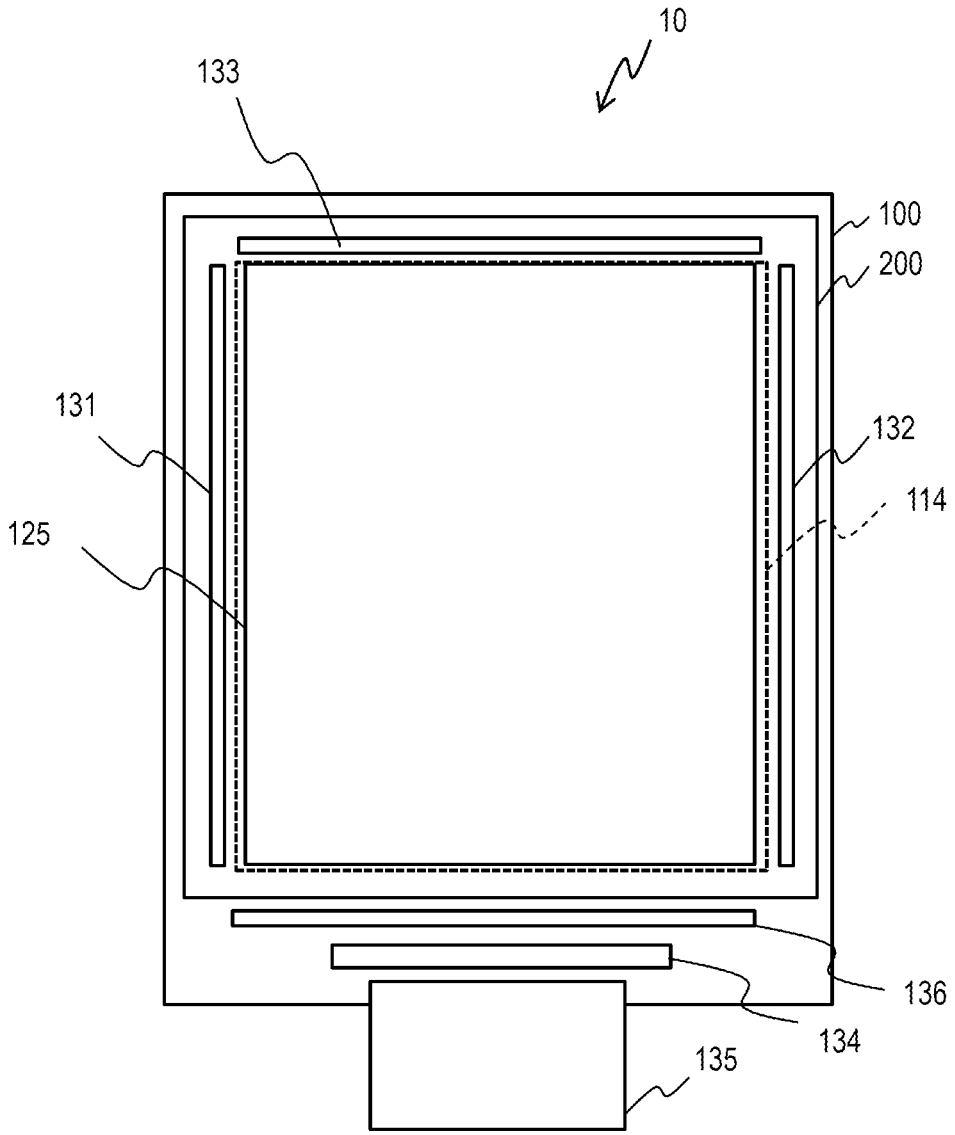
FIG. 1 schematically shows a configuration example of an OLED display device.

Hereinafter, embodiments of this disclosure will be described with reference to the accompanying drawings. It should be noted that the embodiments are merely examples to implement this disclosure and are not to limit the technical scope of this disclosure. Elements common to the drawings are denoted by the same reference signs and some elements in the drawings are exaggerated in size or shape for clear understanding of the description.

In the following description, a pixel is an element which is a minimum unit in a display region and emits light of a single color, and may be called a sub-pixel. A set of a plurality of pixels having different colors, e.g. pixels of red, blue and green, constitutes an element for displaying one color dot and may be called a main pixel. In the case of distinguishing an element for single color display and an element for color display to clarify description, these elements are respectively called the sub-pixel and the main pixel. It should be noted that features of this specification can be applied to a display device for monochrome display and a display region of the display device is composed of monochrome pixels.

A configuration example of the display device is described below. The display region of the display device includes a second region (also called a low-density or low-resolution region) having a relatively small pixel density and a first region (also called a normal region or normal-resolution region) having a relatively large pixel density. A plurality of low-density regions having a lower pixel density than the normal region may be arranged and the pixel densities of these may be different. In the example described below, a light-emitting element of the pixel is a current drive type element and, for example, an OLED (Organic Light-Emitting Diode) element.

A luminance of the pixel is controlled by a pixel circuit. Each pixel circuit row composed of a plurality of pixels is connected to a control line for controlling the pixel circuits. The control lines possibly include scanning lines and light emission control lines. In the display device in which the display region includes regions having different pixel densities, the number of the pixel circuits connected to the control line is possibly different depending on the position of the control line. For example, the number of pixel circuits connected to a control line passing only through the normal region is larger than the number of pixel circuits connected to a control line passing through the region having a small pixel density.

If the numbers of the pixel circuits connected to the control lines are different, loads of those control lines are different. The different loads cause different delays of control signals. A delay of a control line output possibly creates a luminance difference between the pixels. Particularly, a delay time difference of a scanning line possibly varies a gate-source voltage Vgs of a drive transistor in the pixel circuit. As described above, since the loads of the control lines passing only through the display region and those of the control lines passing through the low-density region are different, a luminance difference is easily visually confirmed, with the result that a boundary line between the normal region and the low-density region can be more easily visually confirmed.

A circuit device structure for reducing a delay difference caused by a load difference between the control lines due to output buffer circuits for driving the control lines passing only through the normal region and output buffer circuits for driving the control lines passing though the low-density region is described below. A structure for reducing a delay difference of control signals is mounted outside the display region.

In one embodiment of this specification, a channel width of a drive transistor of an output buffer of a control line passing only through a normal region is larger than that of a drive transistor of an output buffer of a control line passing through a low-density region. In this way, a delay difference between control signals of two control lines can be reduced.

In one embodiment of this specification, a capacitance for adjusting a delay time as compared to the control line passing only through the normal region is added to the control line passing through the low-density region outside the display region. In this way, the delay difference between the control signals of two control lines can be reduced. Both the drive transistors having different channel widths and the additional capacitance outside the display region may be mounted in one display device. In this way, a control signal delay difference between the control lines can be more easily reduced.

[Configuration of Display Device]

With reference to FIG. 1, the overall configuration of the display device according to one embodiment of this specification is described. It should be noted that dimensions and shapes of shown objects may be described in an exaggerated manner to facilitate description. An OLED display device is described as an example of the display device below.

FIG. 1 schematically shows a configuration example of an OLED display device 10. The OLED display device 10 includes a TFT (Thin Film Transistor) substrate 100 formed with OLED elements (light-emitting elements) and a sealing structure 200 for sealing the OLED elements. Control circuits are arranged around a cathode electrode formation region 114 outside a display region 125 of the TFT substrate 100. Specifically, a scan driver 131, an emission driver 132, an electrostatic discharge protection circuit 133, a driver IC 134 and a demultiplexer 136 are arranged.

The drive IC 134 is connected to an external device via a FPC (Flexible Printed Circuit) 135. The scan driver 131 drives scanning lines of the TFT substrate 100. The emission driver 132 controls the light emission of each pixel by driving emission control lines. The electrostatic discharge protection circuit 133 prevents electrostatic discharge damage of the elements on the TFT substrate. The drive IC 134 is mounted, for example, using an anisotropic conductive film (ACF).

The drive IC 134 feeds control signals including power supply and timing signals to the scan driver 131 and the emission driver 132. Further, the driver IC 134 feeds power supply and data signals to the demultiplexer 136. The demultiplexer 136 successively outputs an output of one pin of the drive IC 134 to d (d is an integer equal to or greater than 2) data lines. The demultiplexer 136 drives d times as many data lines as output pins of the drive IC 134 by switching an output destination data line of the data signal from the drive IC 134 *d* times during a scanning period.

[Pixel Circuit Configuration]

Figure 2:
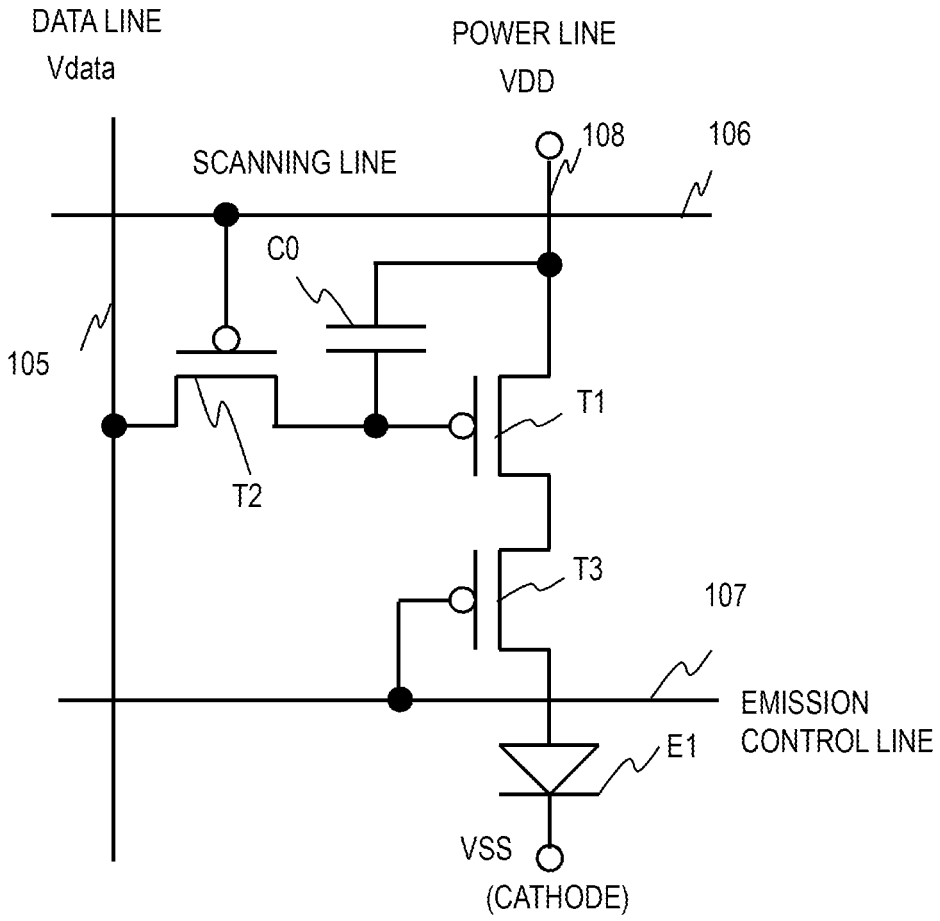
FIG. 2 shows a configuration example of a pixel circuit.

A plurality of pixel circuits for controlling a current to be supplied to each of anode electrodes of a plurality of sub-pixels are formed on the TFT substrate 100. FIG. 2 shows a configuration example of the pixel circuit. Each pixel circuit includes a drive transistor T1, a selection transistor T2, an emission transistor T3 and a retention capacitance C0. The pixel circuit controls the light emission of the OLED element E1. The transistors are TFTs.

In the pixel circuit of FIG. 2, a circuit configuration for compensating for a threshold voltage of the drive transistor is omitted. The pixel circuit of FIG. 2 is an example and the pixel circuit may have another circuit configuration. Although the pixel circuit of FIG. 2 uses P-type TFTs, the pixel circuit may use N-channel-type TFTs.

The selection transistor T2 is a switch for selecting the sub-pixel. The selection transistor T2 is a P-channel-type (P-type) TFT and a gate terminal is connected to a scanning line 106. A source terminal is connected to a data line 105. A drain terminal is connected to a gate terminal of the drive transistor T1.

The drive transistor T1 is a transistor (drive TFT) for driving the OLED element E1. The drive transistor T1 is a P-type TFT and the gate terminal thereof is a connected to the drain terminal of the selection transistor T2. A source terminal of the drive transistor T1 is connected to a power line 108 for transmitting an anode power supply potential VDD. A drain terminal is connected to a source terminal of the emission transistor T3. The retention capacitance C0 is formed between the gate terminal and the source terminal of the drive transistor T1.

The emission transistor T3 is a switch for controlling the supply and stop of a drive current to the OLED element E1. The emission transistor T3 is a P-type TFT and a gate terminal is connected to an emission control line 107. The source terminal of the emission transistor T3 is connected to the drain terminal of the drive transistor T1. A drain terminal of the emission transistor T3 is connected to the OLED element E1. A cathode power supply potential VSS is fed to a cathode of the OLED element E1.

Next, the operation of the pixel circuit is described. The scan driver 131 outputs a selection pulse to the scanning line 106 to turn on the selection transistor T2. A data voltage supplied from the drive IC 134 via the data line 105 is stored in the retention capacitance C0. The retention capacitance C0 retains the stored voltage through one frame period. By the retained voltage, a conductance of the drive transistor T1 changes in an analog manner and the drive transistor T1 supplies a forward bias current corresponding to a light emission gradation to the OLED element E1.

The emission transistor T3 is located on a supply path of the drive current. The emission driver 132 outputs a control signal to the emission control line 107 to on-off control the emission transistor T3. When the emission transistor T3 is on, the drive current is supplied to the OLED element E1. When the emission transistor T3 is off, this supply is stopped. By on-off controlling the emission transistor T3, a lighting period (duty ratio) in one frame period can be controlled.

Figure 3:
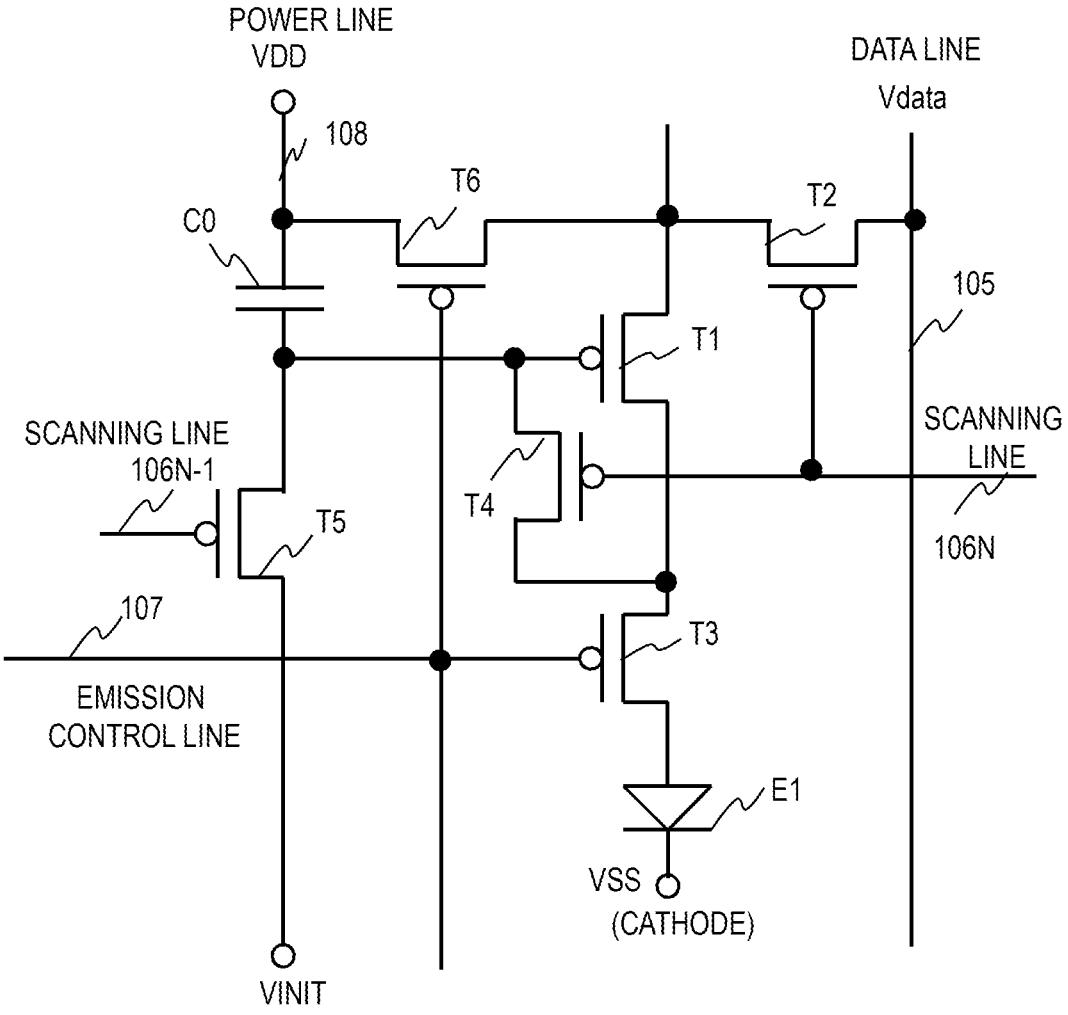
FIG. 3 shows another configuration example of the pixel circuit, FIG. 4 schematically shows a display region.

The configuration of the pixel circuit is not limited to the configuration example of FIG. 2. FIG. 3 shows another configuration example of the pixel circuit. The pixel circuit includes transistors T4, T5 and T6 in addition to a drive transistor T1, a selection transistor T2 and an emission transistor T3. The transistors T1 to T6 are all P-type TFTs. The transistor T2 is connected between a source of the drive transistor T1 and a data line 105.

The transistor T4 is connected to a gate and a drain of the drive transistor T1. The transistor T5 is connected to the gate of the drive transistor T1 and a power line for feeding a power supply potential VINIT. The transistor T6 is connected to the source of the drive transistor T1 and a power line 108 for feeding a power supply potential VDD.

A scanning line 106N-1 transmits a scanning signal from an N-lth output terminal of the scan driver 131. The scanning line 106N transmits a scanning signal from a $N^{th}$ output terminal of the scan driver 131. The transistors T2 and T4 are controlled by the scanning signal of the scanning line 106N. The transistor T5 is controlled by the scanning signal of the scanning line 106N-1. The transistor T6 is controlled by a light emission control signal transmitted by an emission control line 107.

After the scanning line 106N-1 feeds a low-level pulse to the pixel circuit, the scanning line 106N feeds a low-level pulse to the pixel circuit. The light emission control signal transmitted by the emission control line 107 during a period during which these pulses are fed is at a high-level. While the level of the scanning line 106N-1 is low, the transistor T5 is on and the other transistors are off. Thus, an initial potential VINIT is fed to the gate of the drive transistor T1 to initialize a gate potential.

Subsequently, the transistors T2 and T4 are on while the level of the scanning line 106N is low. The other transistors are off. Since the transistor T4 is on, the drive transistor T1 is in a diode connected state. The data signal from the data line 105 is written in the retention capacitance C0 via the transistors T2, T1 and T4. At this time, a voltage compensated with a threshold voltage of the drive transistor T1 is written in the retention capacitance C0.

Thereafter, the transistors T2 and T4 are turned off and the emission transistors T3 and T6 are turned on. A drive current from the drive transistor T1 is fed to the OLED element E1 and the OLED element E1 emits light.

[Pixel Layout]

Figure 4:
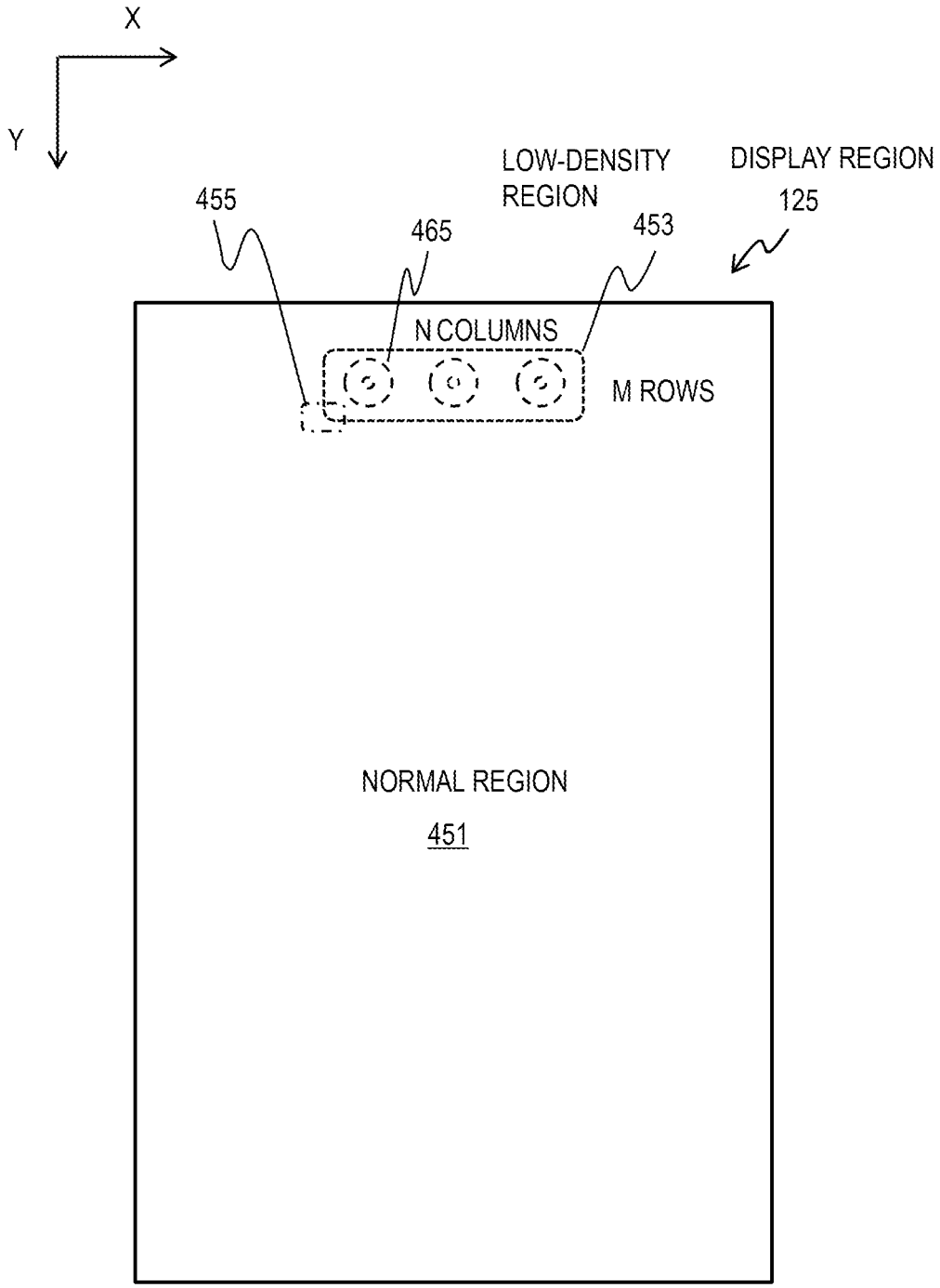

FIG. 4 schematically shows the display region 125. The OLED display device 10 is, for example, mounted in a mobile terminal such as a smartphone or tablet terminal. The display region 125 includes a normal region 451 having a normal pixel density and a low-density region 453 having a pixel density (resolution) lower than the pixel density (resolution) of the normal region 451. One or more cameras 465 are arranged below the low-density region 453. In FIG. 4, one of the plurality of cameras is denoted by a reference sign 465 as an example. The sub-pixels or main pixels in the display region 125 may be called display sub-pixels or display main pixels.

The low-density region 453 is arranged on a visual confirmation side of the cameras 465, and the cameras 465 photograph an object on the visual confirmation side by light having passed through the low-density region 453. The pixel density of the low-density region 453 is lower than that of the surrounding normal region 451 so that photographing by the cameras 465 is not disturbed. An unillustrated control device transmits, for example, data of an image captured by the cameras 465 to the OLED display device 10. It should be noted that although the region below which the cameras are arranged is shown as an example of the low-density region in FIG. 4, features in this specification can be applied to a display device including a region having a relatively low pixel density for another purpose.

The low-density region 453 is composed of main pixels in N columns and M rows. A main pixel column is composed of the main pixels arrayed along a Y axis in a vertical direction in FIG. 4. A main pixel row is composed of the main pixels arrayed along an X axis in a lateral direction in FIG. 4.

Figure 5:
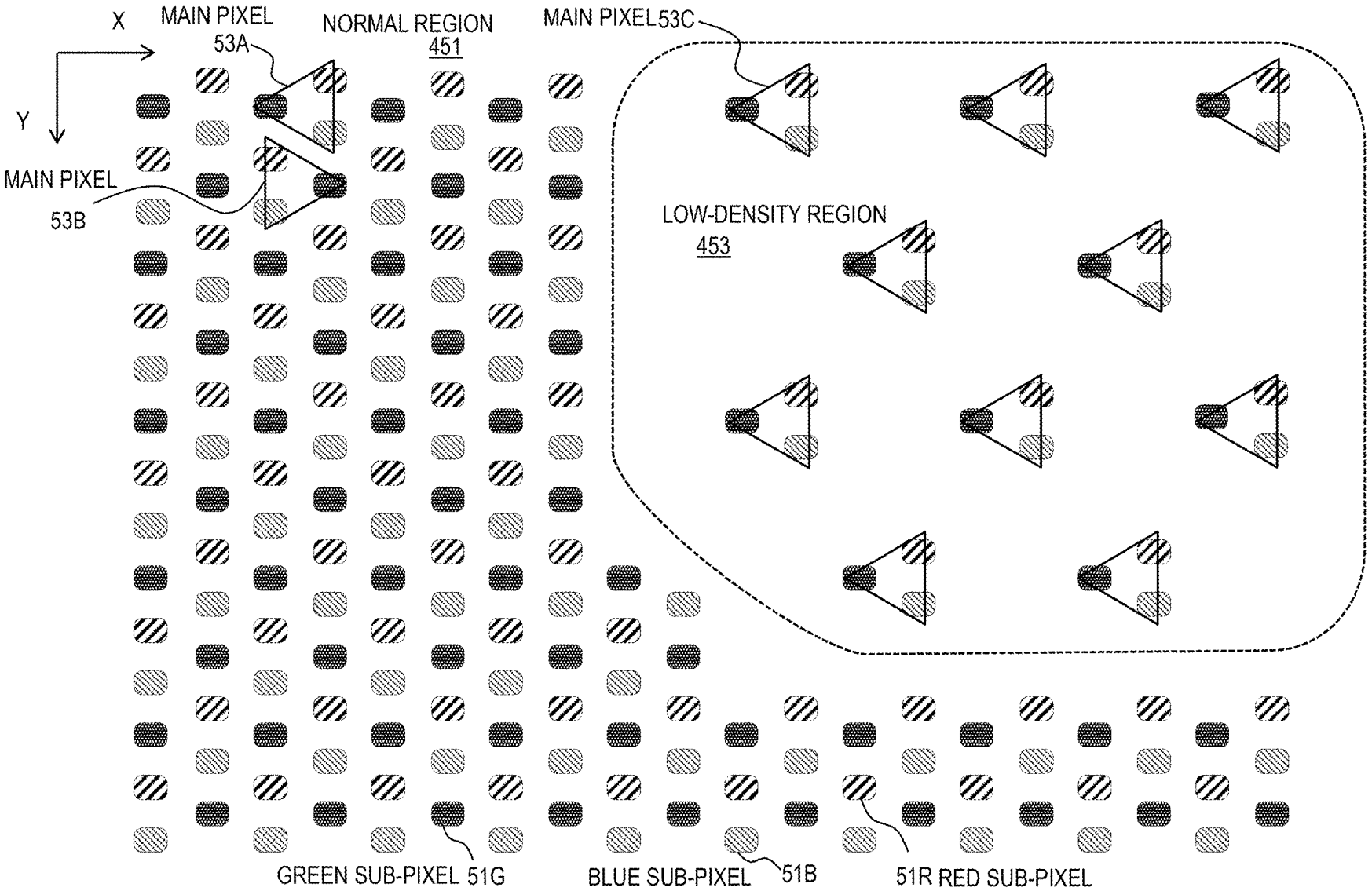
FIG. 5 shows a region enclosed by a dashed-dotted line in FIG. 4 in detail, FIG. 6 schematically shows a layout of a control wiring on a TFT substrate.

FIG. 5 shows a region 455 enclosed by a dashed-dotted line in FIG. 4 in detail. FIG. 5 shows a pixel layout of a delta-nabla arrangement (also merely referred to as a delta arrangement). It should be noted that features in the present embodiment can be applied to a display device having another pixel layout.

The region 455 is a region near a partial boundary between the normal region 451 and the low-density region 453. In an example shown in FIG. 5, the pixel density of the low-density region 453 is ¼ of that of the normal region 451. The sub-pixels of the low-density region 453 are controlled to emit light at four times as high a luminance as the sub-pixels of the normal region 451 for the same image data.

The display region 125 is composed of a plurality of red sub-pixels 51R, a plurality of green sub-pixels 51G and a plurality of blue sub-pixels 51B arranged in a surface. In FIG. 5, one red sub-pixel, one green sub-pixel and one blue sub-pixel are denoted by reference signs as an example. In FIG. 5, rectangles (with rounded corners) of the same hatching indicate the sub-pixels of the same color. Although the sub-pixels have a rectangular shape in FIG. 5, the shape of the sub-pixels is arbitrary and may be, for example, hexagonal or octagonal.

A sub-pixel column is an array composed of the sub-pixels at the same X-axis position and extending along the Y axis. In the sub-pixel column, the red sub-pixels 51R, the blue sub-pixels 51B and the green sub-pixels 51G are cyclically arrayed. For example, the sub-pixels in the sub-pixel column are connected to the same data line. A sub-pixel row is an array composed of the sub-pixels at the same Y-axis position and extending along the X axis. For example, the sub-pixels in the sub-pixel row are connected to the same scanning line.

In the configuration example of FIG. 5, the normal region 451 includes two types of main pixels including first-type main pixels 53A and second-type main pixels 53B arranged in a matrix. In FIG. 5, only one first-type main pixel is denoted by a reference sign 53A as an example. Further, only one second-type main pixel is denoted by a reference sign 53B as an example. It should be noted that, in the case of using a sub-pixel rendering technique, main pixels of image data from outside and those on a panel do not match.

In FIG. 5, the first-type main pixel 53A is indicated by a triangle having one apex on a left side and two apices on a right side. Further, the second-type main pixels 53B is indicated by a triangle having one apex on the right side and two apices on the left side.

In the first-type main pixel 53A, the red and blue sub-pixel 51R, 51B are successively arranged in the same sub-pixel column. The sub-pixel column including the green sub-pixel 51G is adjacent to the left of the sub-pixel 20 column including the red and blue sub-pixels 51R, 51B. The green sub-pixel 51G is located in a center between the red and blue sub-pixels 51R, 51B in a Y direction.

In the second-type main pixel 53B, the red and blue sub-pixel 51R, 51B are successively arranged in the same sub-pixel column. The sub-pixel column including the green sub-pixel 51G is adjacent to the right of the sub-pixel column including the red and blue sub-pixels 51R, 51B. The green sub-pixel 51G is located in a center between the red and blue sub-pixels 51R, 541B in the Y direction.

The low-density region 453 is composed of main pixels 53C having the same configuration as the first-type main pixels 53A. FIG. 5 shows the main pixels 53C in 5 columns and 4 rows. The main pixels 53C are regularly arranged and distances between the main pixels along the X axis and Y axis are constant. Further, adjacent main pixel rows are shifted from each other by a half pitch.

Transparent regions (not shown) are provided in a suitable arrangement between adjacent ones of the main pixels 53C and between the low-density region 453 and the normal region 451 so that the cameras 465 capture light from the visual confirmation side for imaging by the cameras 465.

A sub-pixel layout of the low-density region 453 has a configuration obtained by removing some sub-pixels from the layout of the normal region 451. The sub-pixels of the low-density region 453 constitute the sub-pixel columns and sub-pixel rows together with the sub-pixels of the normal region. Each sub-pixel column of the low-density region 453 constitutes one sub-pixel column together with the corresponding sub-pixel column of the normal region 451 and is connected to the same data line. Each sub-pixel row of the low-density region 453 constitutes one sub-pixel row together with the corresponding sub-pixel row of the normal region 451 and is connected to the same scanning line.

[Wiring Layout]

Figure 6:
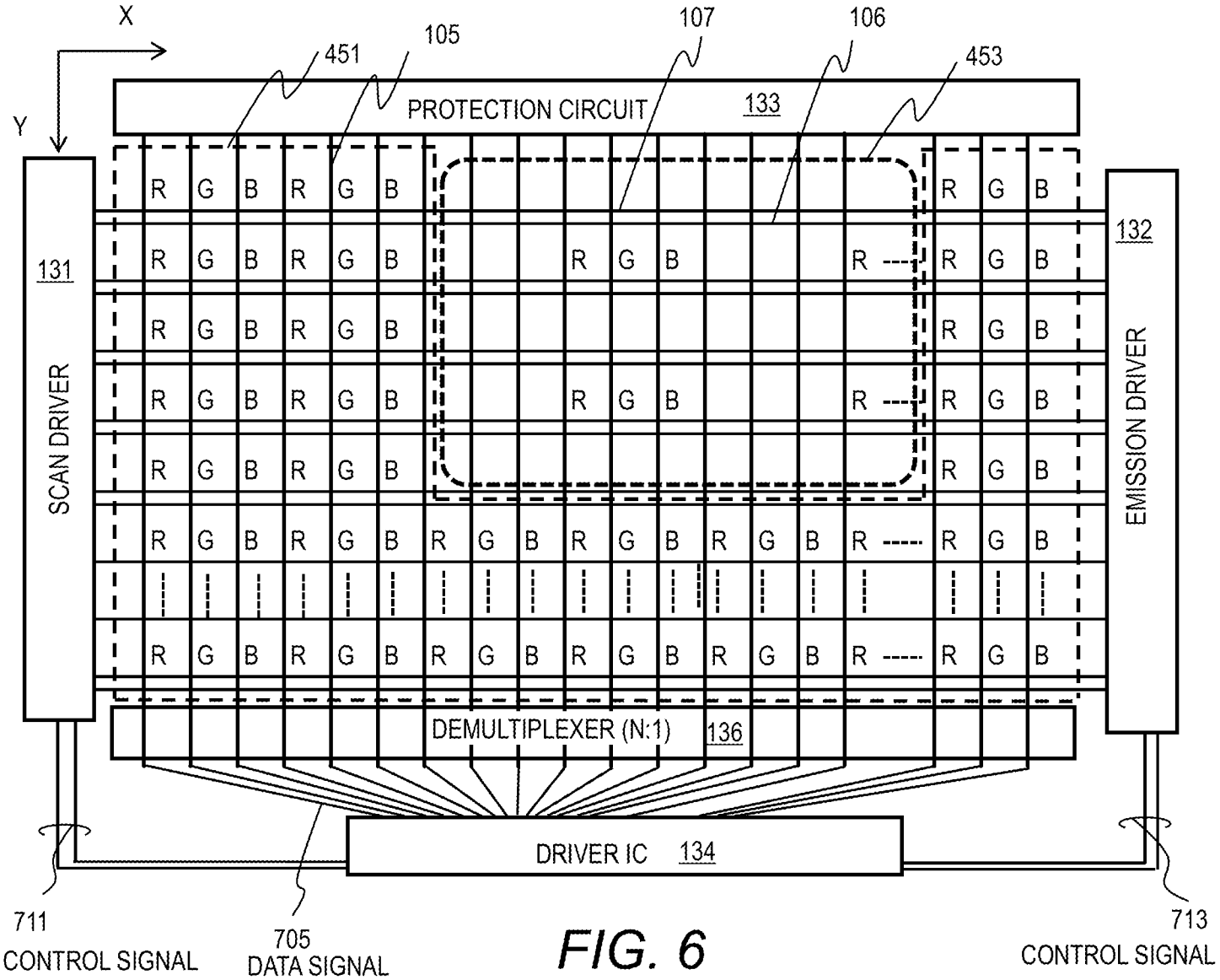

A wiring layout example of the OLED display device 10 is described below. FIG. 6 schematically shows the layout of a control wiring on the TFT substrate 100. In a configuration example of FIG. 6, the layout of the pixel circuits of the normal region 451 is a striped arrangement. Specifically, the sub-pixel column extending along the Y axis is composed of sub-pixels of the same color. The sub-pixel row extending along the X axis is composed of the cyclically arranged red sub-pixels, green sub-pixels and blue sub-pixels. The low-density region 453 has a configuration obtained by thinning some pixels from the pixel layout of the normal region 451. No pixel circuit including OLED element is formed and only the transparent regions and the wiring are arranged in blank regions in the low-density region 453.

It should be noted that each transistor constituting the pixel circuits of the main pixels 53A, 53C adjacent to the transparent regions is properly light-shielded (not shown). The reason for that is to prevent a light assist effect in the transistors due to outside light entering also the pixel circuits via thin film layers forming the TFT substrate 100 and the OLED elements since the outside light is incident on the transparent regions from the visual confirmation side according to photographing by the cameras. If the light assist effect occurs, it causes shifts of threshold voltages of the transistors, wherefore a drive current changes.

A plurality of the scanning lines 106 extend along the X axis from the scan driver 131. Further, a plurality of the emission control lines 107 extend along the X axis from the emission driver 132. In FIG. 6, one scanning line and one emission control line are respectively denoted by reference signs 106 and 107 as an example.

In the configuration example shown in FIG. 6, the scanning lines 106 transmit selection signals (also called scanning signals) of the normal region 451 and the low-density region 453. Further, the emission control lines 107 transmit emission control signals of the normal region 451 and the low-density region 453. The selection signals and the emission control signals are control signals of the pixel circuits.

The drive IC 134 transmits a control signal to the scan driver 131 by a wiring 711 and transmits a control signal to the emission driver 132 by a wiring 713. The drive IC 134 controls timings of the scanning signal (selection pulse) from the scan driver 131 and the emission control signal of the emission driver 132 based on image data (image signal) from outside.

The drive IC 134 feeds data signals of the sub-pixels of the normal region 451 and the low-density region 453 to the demultiplexer 136 by wirings 705. In FIG. 6, one wiring is denoted by a reference sign 705 as an example. The drive IC 134 determines the data signal of each pixel circuit corresponding to each sub-pixel of the normal region 451 and the low-density region 453 from gradation level(s) of one or more sub-pixels in a frame of video data from outside.

The demultiplexer 136 successively outputs one output of the drive IC 134 to N (N is an integer equal to or greater than 2) data lines 105 within the scanning period. In FIG. 6, out of a plurality of data lines extending along the Y axis, one data line is denoted by a reference sign 105 as an example.

[Output Buffer]

A configuration for reducing delay differences of control signals from the scan driver 131 is described below. The following description may also be applied to the emission driver 132. As described with reference to FIGS. 4 to 6, the density of the pixel circuits connected to the scanning lines in the low-density region 453 is smaller than that of the pixel circuits connected to the scanning lines in the normal region 451. In an example described below, the scanning lines are assumed to be divided into three groups according to the number of the connected pixel circuits.

A-type scanning line passes only through the normal region 451 without passing through the low-density region 453. The pixel circuits connected to the A-type scanning line are composed only of the pixel circuits in the normal region 451 and the number of the connected pixel circuits is largest.

A B-type scanning line passes through the normal region 451 and the low-density region 453. The pixel circuits connected to the B-type scanning line are composed of the pixel circuits in the normal region 451 and the low-density region 453. The number of the pixel circuits connected to the B-type scanning line is smaller than the number of the pixel circuits connected to the A-type scanning line.

A C-type scanning line passes through the normal region 451 and the low-density region 453. The pixel circuits connected to the C-type scanning line are composed only of the pixel circuits in the normal region 451. That is, the C-type scanning line passes through non-light emission regions of the low-density region 453 where the pixel circuits are not formed. The number of the pixel circuits connected to the C-type scanning line is smaller than the number of the pixel circuits connected to the B-type scanning line, i.e. smallest.

The output terminal of the scan driver 131 may be connected only to one pixel circuit row as shown in the pixel circuit example of FIG. 2 or may be connected to different scanning lines of different pixel circuit rows and simultaneously output a scanning signal to those as shown in the pixel circuit example of FIG. 3. In an example described below, the output terminals of the scan driver 131 are assumed to be classified similarly to the three types of the scanning lines described above. One output buffer corresponds to one output terminal of the scan driver 131. It should be noted that the number of the pixel circuits controlled by one output buffer is not limited to the above three types and may be possibly two, four or more types depending on the design of the display device.

Figure 7:
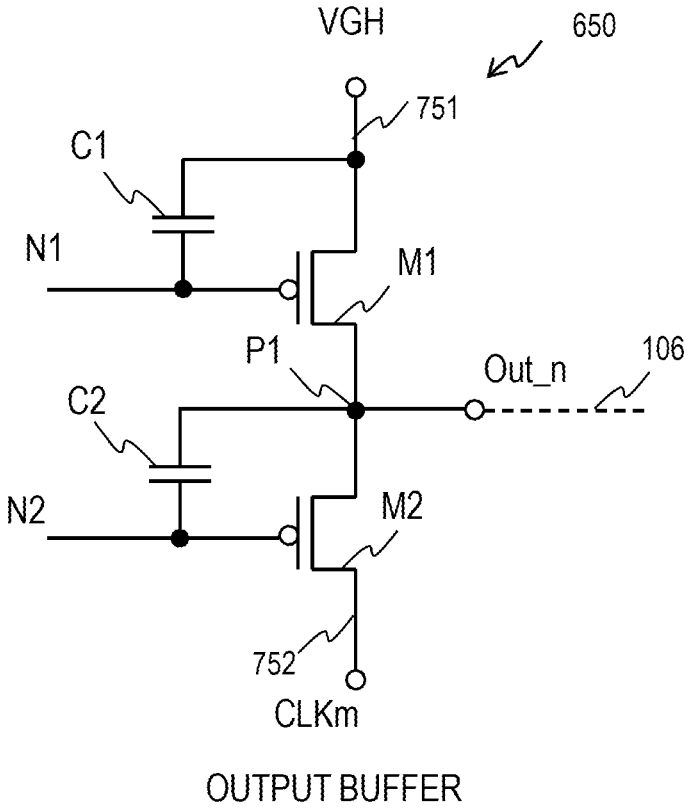
FIG. 7 shows a circuit configuration example of an output buffer of one output terminal of a scan driver.

FIG. 7 shows a circuit configuration example of an output buffer 650 of one output terminal of the scan driver 131.

FIG. 7 shows an $n^{th}$ output buffer. The output buffer 650 includes two drive transistors M1 and M2 connected in series between a power line 751 for feeding a high level potential VGH and a clock line 752 for feeding a clock signal CLKm.

In the configuration example of FIG. 7, the transistors M1 and M2 are P-type TFTs and signals N1 and N2 are respectively fed to gates thereof. The output buffer 650 outputs a scanning signal (control signal) Out_n to the scanning line 106 from an intermediate node P1 between the transistors M1 and M2.

A capacitance C1 is connected between the gate of the transistor M1 and the power line 751 for feeding the high-level potential VGH. A capacitance C2 is connected between the gate of the transistor M2 and the intermediate node P1 between the transistors M1 and M2.

Figure 8:
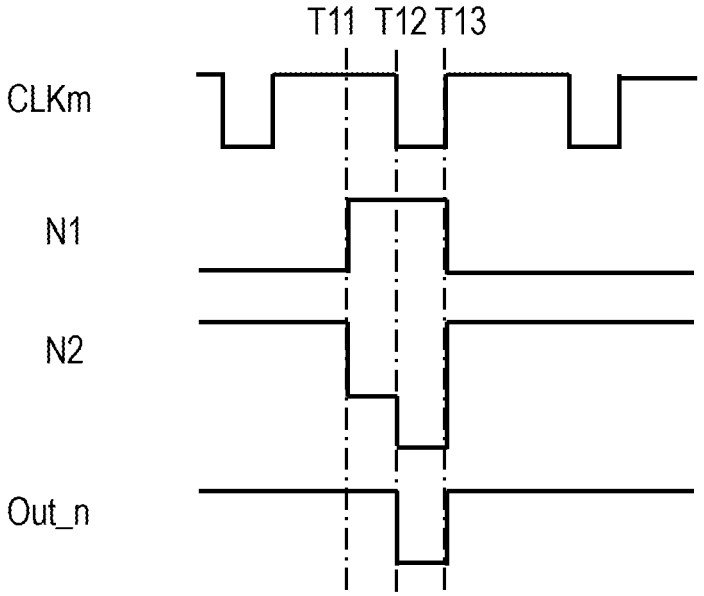
FIG. 8 shows a timing chart of signals of an output buffer, FIG. 9 schematically shows changes with time of scanning signals from three output buffers having different numbers of pixel circuits to be controlled.

FIG. 8 shows a timing chart of signals of the output buffer 650. The clock signal CLKm changes between a high level and a low level in a fixed cycle. At time T11, the signal N1 changes from a low level to a high level, and the signal N2 changes from a high level to a low level. The clock signal CLKm is at the high level. The output signal Out_n is at a reference high level.

At time T12, the clock signal CLKm changes from the high level to the low level, and the signal N2 changes to an even lower level. The output signal Out_n changes from a high level to a low level. At time T13, the clock signal CLKm changes from the low level to the high level, the signal N1 changes from the high level to the low level and the signal N2 changes to the high level. The output signal Out_n changes from the low level to the high level. A selection pulse of the output signal Out_n is output from time T12 to time T13.

Figure 9:
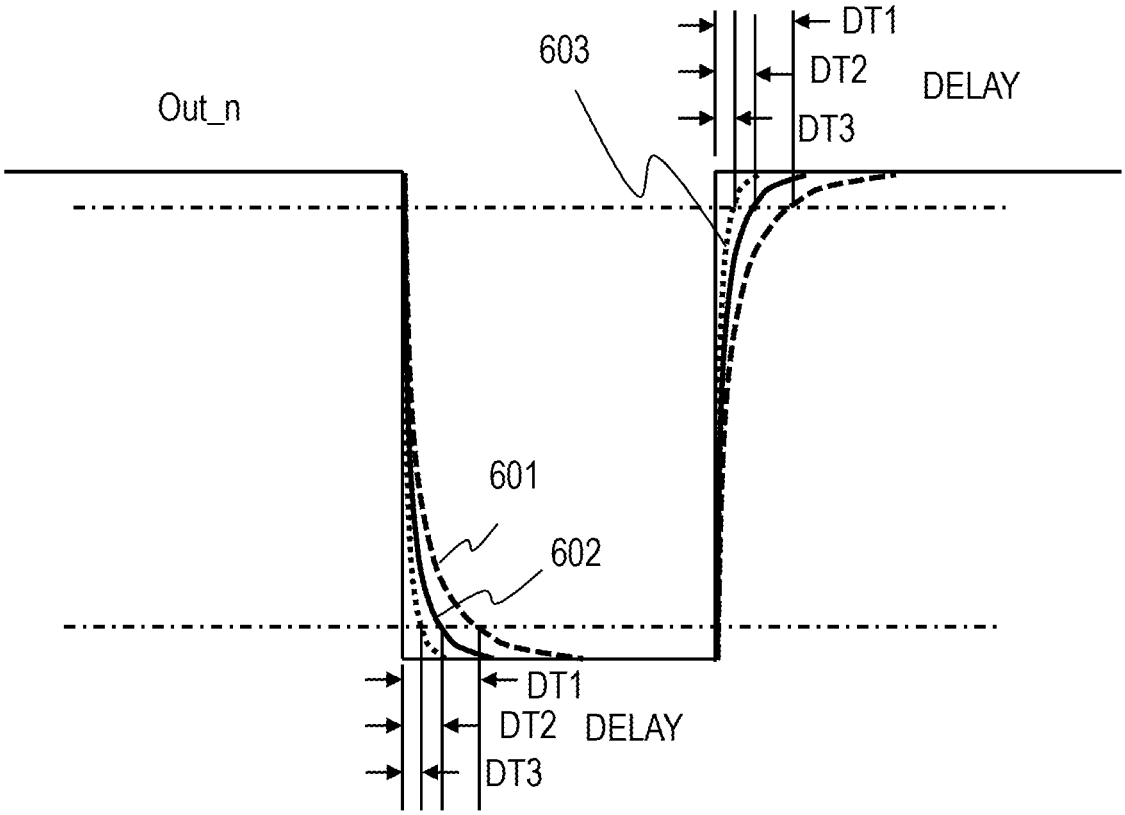

FIG. 9 schematically shows changes with time of scanning signals from three output buffers having different numbers of the pixel circuits to be controlled. A horizontal axis represents time and a vertical axis represents a potential level of the scanning signal. A scanning signal 601 has a largest delay DT1. A delay DT2 of a scanning signal 602 is smaller than the delay DT1 of the scanning signal 601. A delay DT3 of a scanning signal 603 is smallest.

The scanning signal 601 having the largest delay is a scanning signal of the A-type output buffer configured to drive only the pixel circuits in the normal region 451 and having a largest number of the pixel circuits to be driven. The scanning signal 602 having the second largest delay is a scanning signal of the B-type output buffer configured to drive the pixel circuits in the normal region 451 and the low-density region 453 and having the second largest number of the pixel circuits to be driven. The scanning signal 603 having the smallest delay is a scanning signal of the C-type output buffer configured to drive only the pixel circuits in the normal region 451 by passing through the normal region 451 and the non-light emission regions of the low-density region 453 and having the smallest number of the pixel circuits to be driven. The A-type output buffer, B-type output buffer and C-type output buffer are respectively a first output buffer, a second output buffer and a third output buffer.

As shown in FIG. 9, the delays of the scanning signals (drive signals) of the three types of the output buffers are respectively different. By reducing differences among these delays, differences among light emission luminances of the pixels can be reduced. A method for reducing delay time differences by adjusting channel widths of the drive transistors of the output buffers is described below. By optimizing the channel widths, differences among delay times T1, T2 and T3 can be eliminated.

Figure 10:
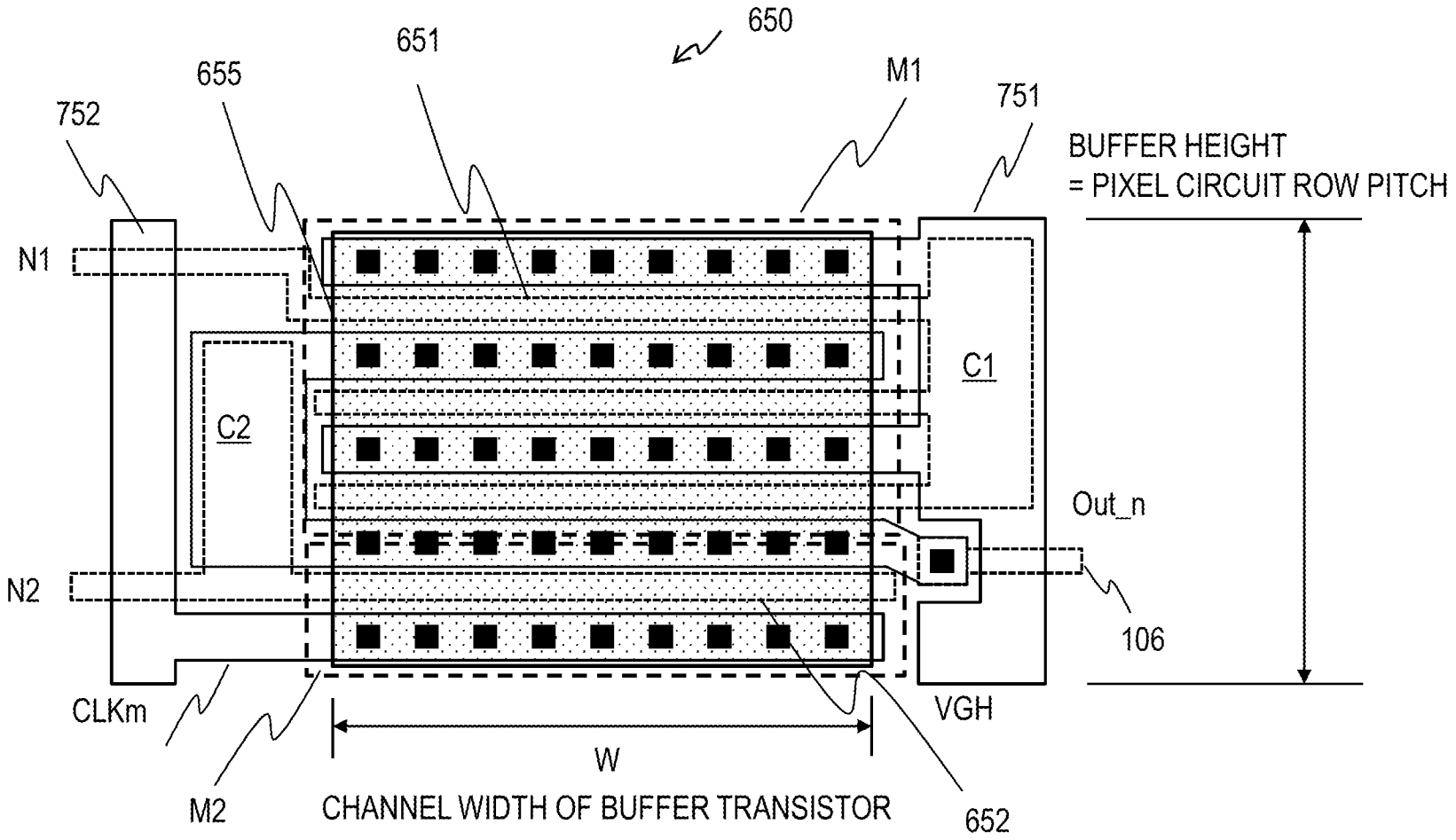
FIG. 10 is a plan view schematically showing an example of a device structure of the output buffer.

Before the channel widths of the drive transistors of the different types of the output buffers are described, the device structure of the output buffer described with reference to FIG. 7 is described. FIG. 10 is a plan view schematically showing an example of the device structure of the output buffer 650. As shown in FIG. 7, the output buffer 650 includes the transistors M1 and M2 and the capacitances C1 and C2. A buffer height of the output buffer 650 matches a pixel circuit row pitch. The buffer height is a vertical dimension in FIG. 10.

In a configuration example shown in FIG. 10, a semiconductor film 655 is a bottom layer, a source/drain metal layer (M2 metal layer) is a top layer, and a gate electrode layer (M1 metal layer) is an intermediate layer between those. The different layers are shown in different modes. The semiconductor film 655 is shown by a solid-line rectangle filled with a dot pattern. The source/drain metal layer is shown by a solid line and the gate electrode layer is shown by a broken line.

The source/drain metal layer includes source/drain electrodes of the transistors in the display region 125, source/drain electrodes of the transistors M1 and M2, the power line 751 and the clock signal line 752. The gate electrode layer includes the gate electrodes of the transistors in the display region 125, gate electrodes 651, 652 of the transistors M1 and M2 and lower electrodes of the capacitances C1, C2. The power line 751 includes an upper electrode of the capacitance C1, and the clock signal line 752 includes an upper electrode of the capacitance C2.

In the configuration example shown in FIG. 10, the transistor M1 includes three gate electrodes 651 overlapping the semiconductor film 655 in a plan view. In FIG. 10, one gate terminal is denoted by a reference sign 651 as an example. The transistor M2 includes only one gate electrode 652 overlapping the semiconductor film 655 in a plan view. The channel width of the transistor M1 is three times as large as that of the transistor M2, and the drive capability of the transistor M1 is higher than that of the transistor M2. As shown in FIG. 10, the channel widths of the transistors M1, M2 can be changed by changing a lateral dimension W of the semiconductor film 655.

Figure 11:
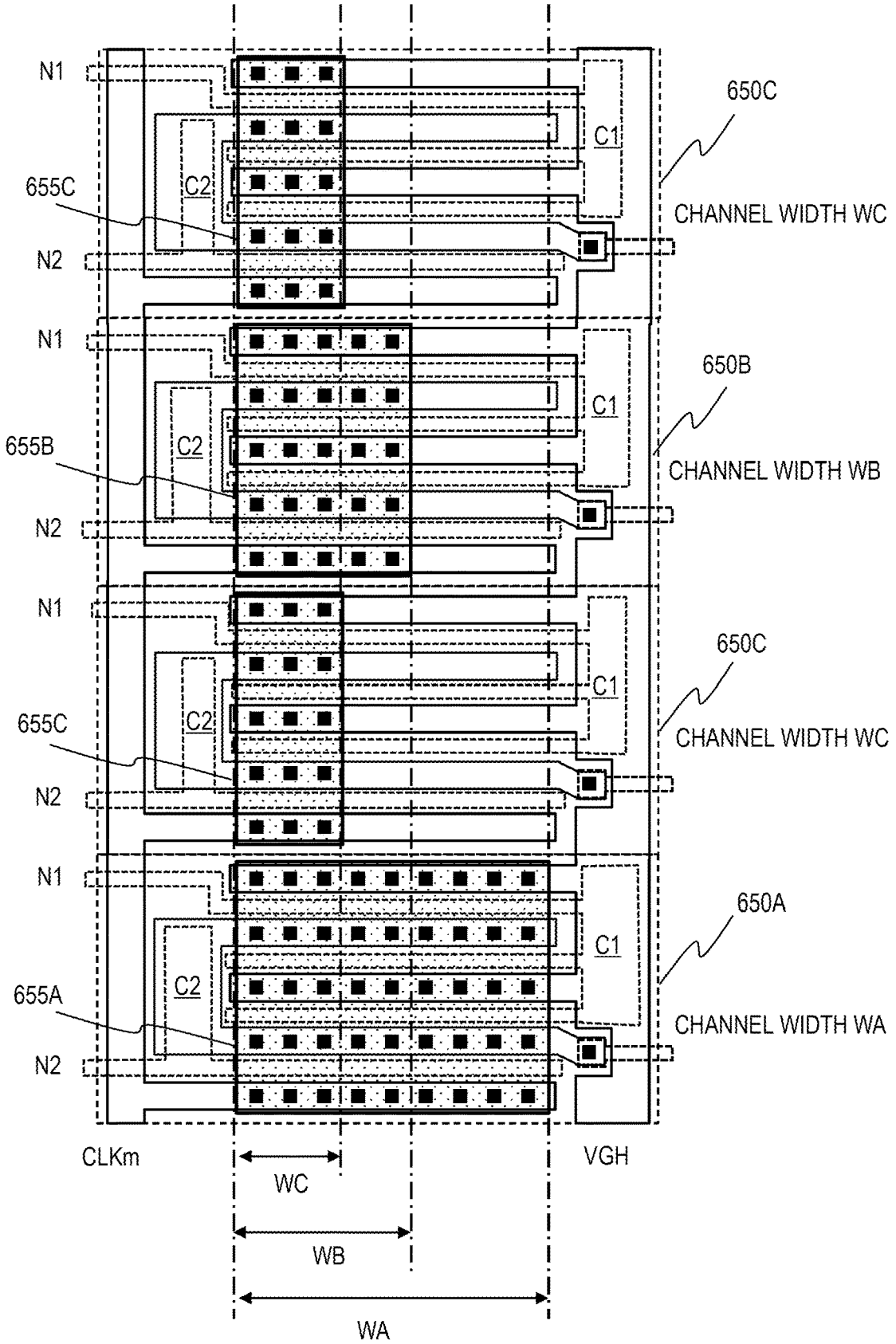
FIG. 11 is a plan view schematically showing A-type, B-type and C-type output buffers included in the scan driver.

FIG. 11 is a plan view schematically showing the A-type, B-type and C-type output buffers included in the scan driver 131. FIG. 11 shows one A-type output buffer 650A, one B-type output buffer 650B and two C-type output buffers 650C.

The A-type, B-type, and C-type output buffers 650A, 650B and 650C respectively have channel widths WA, WB and WC. The channel widths WA, WB and WC are different, the channel width WA is largest and the channel width WC is smallest.

The A-type output buffer 650A drives the scanning lines passing only through the normal region 451. The A-type output buffer 650A is an output buffer for driving a largest number of pixel circuits and drives only the pixel circuits in the normal region 451.

The B-type output buffer 650B drives the scanning lines passing through the normal region 451 and the low-density region 453. The B-type output buffer 650B is an output buffer for driving a second largest number of pixel circuits and drives the pixel circuits in the normal region 451 and the low-density region 453.

The C-type output buffer 650C drives the scanning lines passing through the normal region 451 and the low-density region 453. The C-type output buffer 650C is an output buffer for driving a smallest number of pixel circuits and drives only the pixel circuits in the normal region 451.

As described above, the output buffers 650A, 650B and 650C have the channel widths WA, WB and WC corresponding to the numbers of the pixel circuits to be driven, whereby delay differences of the scanning signals can be reduced. In an example, the channel widths WA, WB and WC are so determined that the delays of the signals from the output buffers 650A, 650B and 650C are equal.

In a configuration example shown in FIG. 11, the output buffers 650A, 650B and 650C include semiconductor films 655A, 655B and 655C having different widths. The widths of the semiconductor films 655A, 655B and 655C are lateral dimensions in FIG. 11. The channel widths of the transistors M1 and M2 can be increased by increasing the widths of the semiconductor films 655A, 655B and 655C, whereas the channel widths of the transistors M1 and M2 can be reduced by reducing these widths.

Parameters of the device structures (laminated structures) of the transistors M1 and M2 are common except the widths of the semiconductor films 655A, 655B and 655C among the output buffers 650A, 650B and 650C. That is, only the widths of the semiconductor films 655A, 655B and 655C are different in the transistors M1 and M2 of the output buffers 650A, 650B and 650C. In this way, the transistors have the same configuration except the widths of the semiconductor films specifying the channel widths, whereby the output buffers including the transistors having different channel widths can be easily designed.

In the configuration example of FIG. 11, the output buffers 650A, 650B and 650C include the capacitances C1 and C2 having different capacitance values. The capacitance value of the capacitance C1 of the output buffer 650A is larger than those of the capacitances C1 of the output buffers 650B, 650C. The capacitance value of the capacitance C1 of the output buffer 650C is smaller than those of the capacitances C1 of the output buffers 650A, 650B. The capacitance value of the capacitance C2 of the output buffer 650A is larger than those of the capacitances C2 of the output buffers 650B, 650C. The capacitance value of the capacitance C2 of the output buffer 650C is smaller than those of the capacitances C2 of the output buffers 650A, 650B. In the configuration example of FIG. 11, different values of the capacitances C1, C2 are realized by different areas of the lower electrodes included in the gate electrode layers.

[Delay Adjusting Additional Capacitance]

Figure 12:
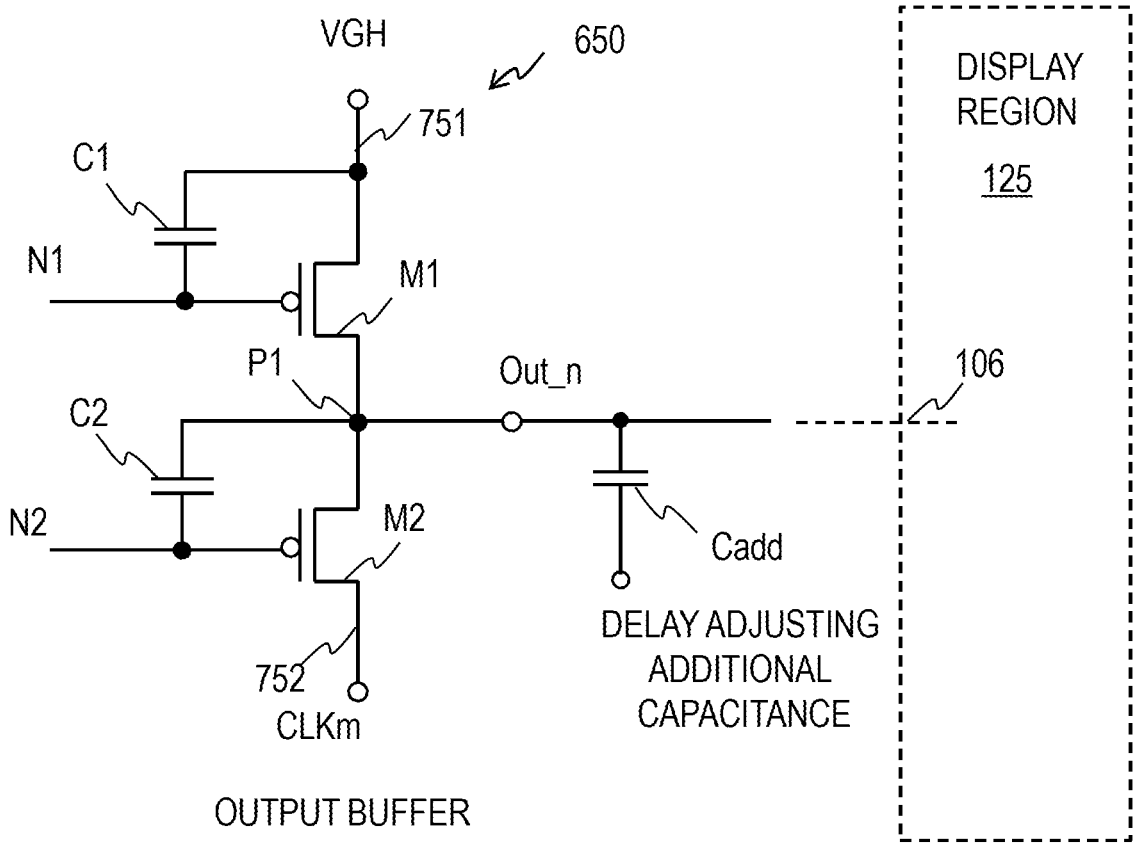
FIG. 12 shows an example of a delay adjusting additional capacitance added to an output line of the output buffer.

Next, a method is described which reduces delay differences among output buffers by adding delay adjusting capacitances to the outputs of the output buffers. FIG. 12 shows an example of a delay adjusting capacitance added to an output line of the output buffer 650. The circuit configuration of the output buffer 650 is as described with reference to FIG. 7.

A delay adjusting additional capacitance Cadd is arranged in a region between the display region 125 and the transistors M1 and M2 of the output buffer 650. One end of the delay adjusting additional capacitance Cadd is electrically connected to an output of the output buffer 650, and the other end is electrically connected to any one of power supplies. The delay adjusting additional capacitance Cadd can be, for example, connected to any one of a positive power supply of the output buffer 650, a negative power supply of the output buffer 650, an anode power supply of the display region 125 and a cathode power supply of the display region 125.

For example, a capacitance CaddB is added to an output of the B-type output buffer 650B, and a capacitance CaddC is added to an output of the C-type output buffer 650C. The capacitance CaddB is a first additional capacitance, and the capacitance CaddC is a second additional capacitance. No additional capacitance is necessary for the A-type output buffer 650A. The additional capacitance CaddC is larger than the additional capacitance CaddB. By appropriately selecting the sizes of the additional capacitances CaddB, CaddC, the delay differences among the A-type output buffer 650A, B-type output buffer 650B and C-type output buffer 650C can be reduced.

CscanA, CscanB and CscanC respectively denote scanning line capacitances of the output buffers 650A, 650B and 650C. If the following equation is satisfied, the delays of the signals from the output buffers 650A, 650B and 650C can be made equal.

$$CscanA = CscanB + CaddB = CscanC + CaddC$$

To largely reduce the delay differences only by the additional capacitances, large areas for the additional capacitances are necessary and a frame region is possibly expanded. Thus, signal delay differences among the output buffers 650A, 650B and 650C may be reduced by adopting both the adjustment of the buffer sizes (channel widths) of the output buffers and the additional capacitances as described above.

Figure 13:
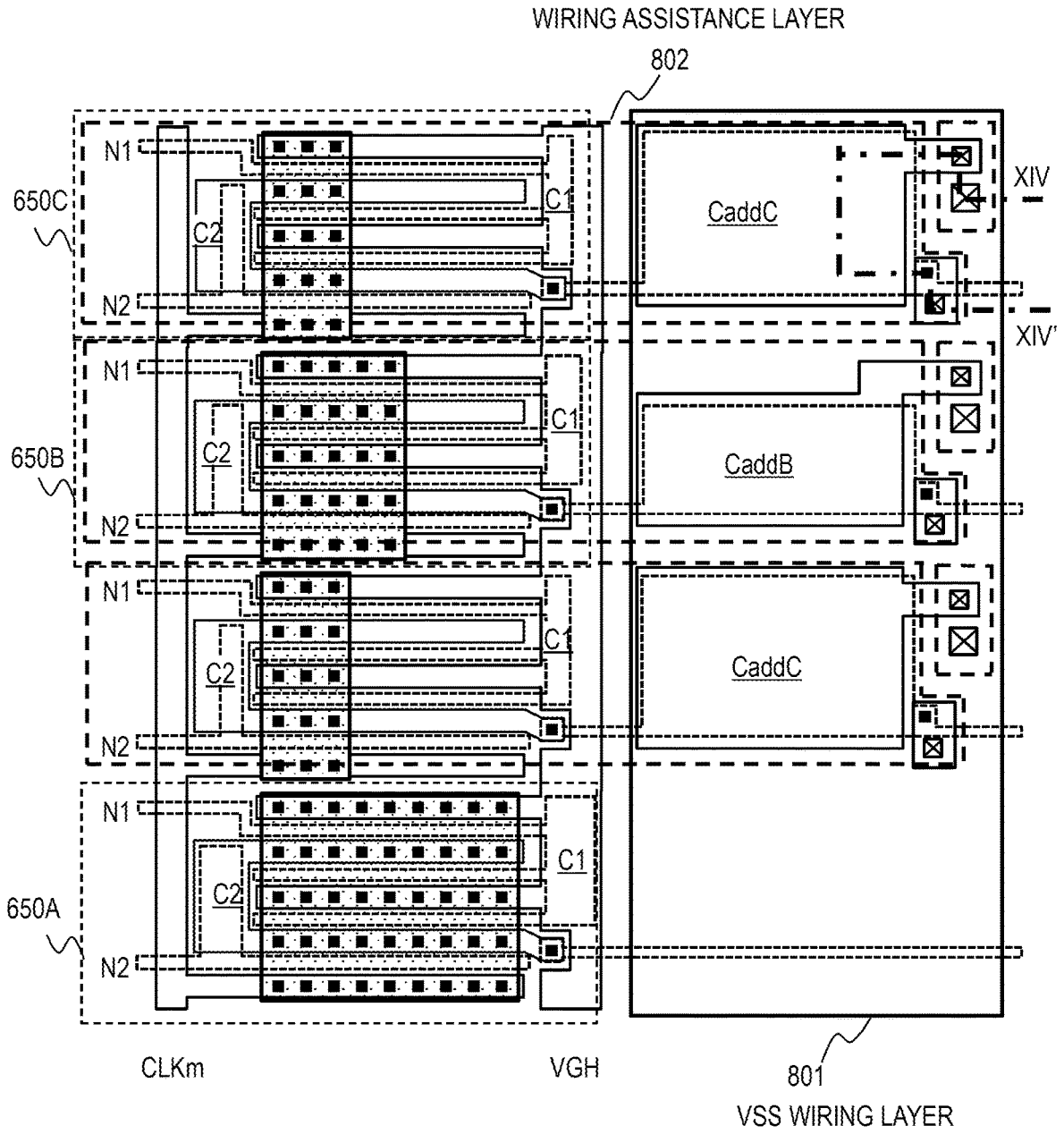
FIG. 13 is a plan view schematically showing structures of output buffers and delay adjusting additional capacitances, and FIG. 14 schematically shows a cross-sectional structure along a cutting line XIV-XIV' in FIG. 13.

FIG. 13 is a plan view schematically showing the structures of the output buffers and the delay adjusting additional capacitances of the output buffers. The additional capacitances are further added to the output buffers shown in FIG. 11. The structures of the output buffers 650A, 650B and 650C are as described with reference to FIG. 11.

The additional capacitance CaddB is connected to an output of the output buffer 650B. Further, the additional capacitance CaddC is connected to an output of the output buffer 650C. The capacitance value of the additional capacitance CaddC is larger than that of the additional capacitance CaddB. In a structure example of FIG. 13, an area of the additional capacitance CaddC is larger than that of the additional capacitance CaddB. Values of other capacitance parameters are equal. The additional capacitance CaddB is arranged between the output buffer 650B and the display region 125, and the additional capacitance CaddC is arranged between the output buffer 650C and the display region 125.

In a configuration example of FIG. 13, the additional capacitance is composed of a plurality of conductor layers and insulator layers on the TFT substrate 100. In this way, the capacitance value of the additional capacitance can be increased in a small area. In the configuration example of FIG. 13, each of the source/drain metal layer, the gate electrode layer, a VSS wiring layer 801 and a wiring assistance layer 802 includes parts of electrodes of the additional capacitance. The VSS wiring layer 801 transmits a cathode potential VSS of the OLED element E1.

The wiring assistance layer 802 is a wiring layer provided to enhance the durability of a wiring in a part to be bent and mounted in a panel surrounding part, and provided at a position above a source/drain electrode wiring layer and below an anode electrode layer. By removing all inorganic films other than the wiring assistance layer 802 in the bent part, the durability of a flexible substrate can be enhanced.

Figure 14:
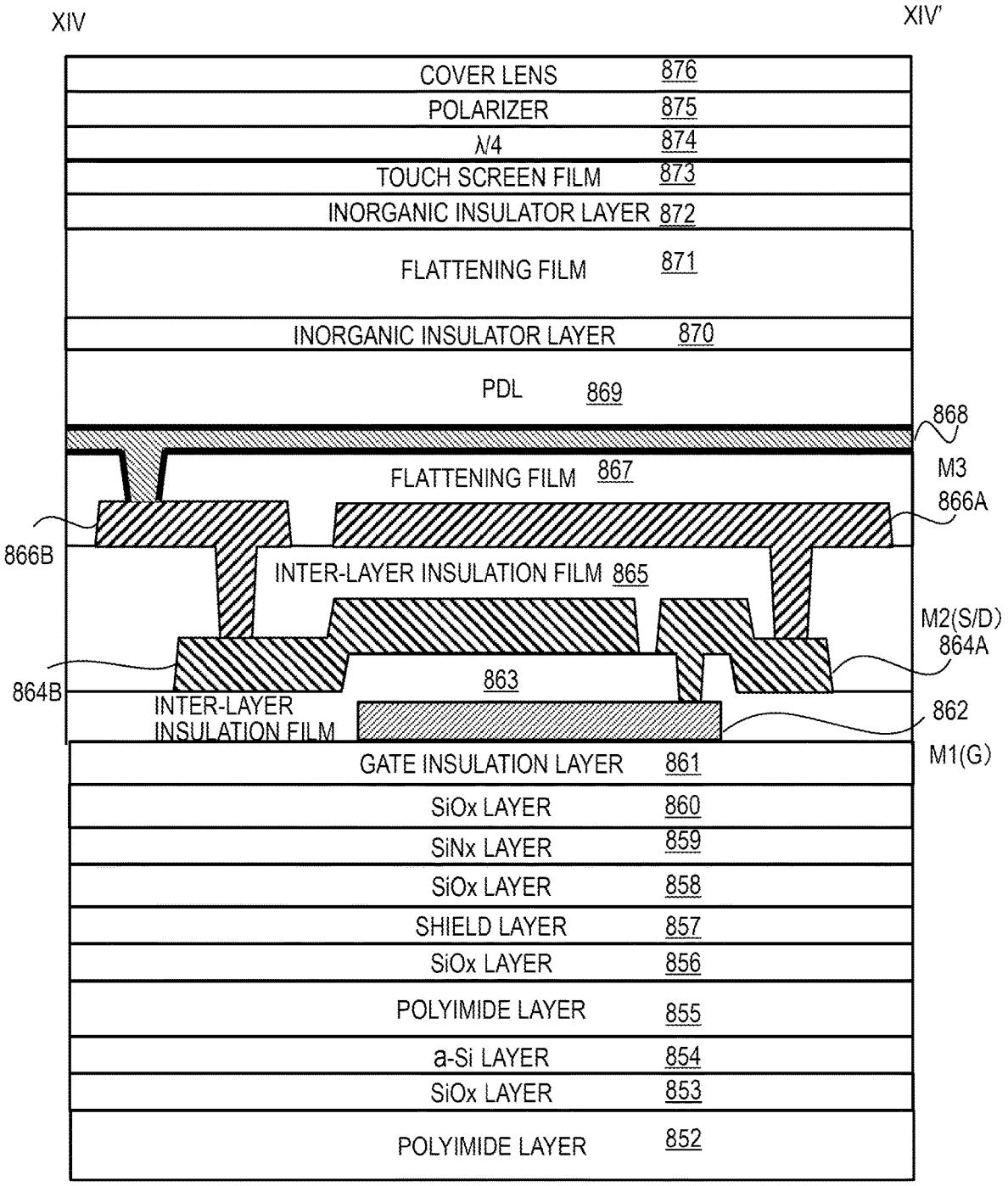

The structure of the additional capacitance is described in detail below. FIG. 14 schematically shows a cross-sectional structure along a cutting line XIV-XIV' in FIG. 13. In the following description, upper and lower sides indicate upper and lower sides in FIG. 14. Layers constituting a laminated structure shown in FIG. 14 are also present in the display region 125. The OLED display device 10 includes a polyimide layer 852, a silicon oxide layer (SiOx layer) 853, an amorphous silicon layer (a-Si layer) 854 and a polyimide layer 855 from below.

The OLED display device 10 further includes a silicon oxide layer 856, a shield layer 857, a silicon oxide layer 858 and a silicon nitride layer (SiNx layer) 859 from below on the polyimide layer 855.

The silicon oxide layer 853 and the amorphous silicon layer 854 improve the adhesion of two polyimide layers 852 and 855. The peeling of the upper polyimide layer 855 from the lower polyimide layer 852 can be prevented by the silicon oxide layer 853 and the amorphous silicon layer 854.

The shield layer 857 is a conductor layer for reducing the influence of a magnetic field from electric charges present in the polyimide layer 855 or 852. The shield layer 857 is formed to cover the entire surface of the polyimide layer 855. The shield layer 857 is, for example, formed of transparent amorphous oxide such as ITO and IZO.

The silicon oxide layer 856 can improve the adhesion of the shield layer 857 to the polyimide layer 855. The silicon oxide layer 858 improves the adhesion of the shield layer 857 and the silicon nitride layer 859 and acts as a barrier layer for moisture and oxygen for the OLED element. The silicon nitride layer 859 also acts as a barrier layer.

A silicon oxide layer 860 and a gate insulation layer 861 are formed from below on the silicon nitride layer 859. The gate insulation layer 861 is, for example, formed of silicon oxide or silicon nitride or a laminate of these. The gate insulation layer 861 includes gate insulation films of the transistors in the drivers 131, 132 and the display region 125.

An electrode 862 included in the gate electrode layer (M1 metal layer) is arranged on the gate insulation layer 861. The electrode 862 can be, for example, formed of Mo. The gate electrode layer (M1 metal layer) incudes gate electrode insulation films of the transistors in the drivers 131, 132 and the display region 125. An inter-layer insulation film 863 is formed to cover the electrode 862.

Electrodes 864A, 864B included in the source/drain metal layer (M2 metal layer) are formed on the inter-layer insulation film 863. The source-drain metal layer is, for example, formed of high melting point metal or alloy thereof. The electrode 864A is connected to the electrode 862 via a contact hole formed in the inter-layer insulation film 863. The source/drain metal layer (M2 metal layer) includes source/drain electrodes of the transistors in the drivers 131, 132 and the display region 125.

An inter-layer insulation film 865 is formed to cover the electrodes 864A, 864B of the source/drain metal layer. Electrodes 866A, 866B included in the wiring assistance layer (M3 metal layer) are formed on the inter-layer insulation film 865. The wiring assistance layer is, for example, formed of Al. The electrodes 866A is connected to the electrode 864A via a contact hole formed in the inter-layer insulation film 865. The electrode 866B is connected to the electrode 864B via a contact hole formed in the inter-layer insulation film 865.

An organic flattening film 867 is formed to cover the electrodes 866A, 866B. An electrode 868 included in a layer of the anode electrode of the OLED element E1 is formed on the flattening film 867. The electrode 868 has the same layered structure as the anode electrode and is, for example, composed of a reflective metal layer in a center and transparent conductive layers sandwiching the reflective metal layer. The electrode 868 has, for example, an ITO/Ag/ITO structure or IZO/Ag/IZO structure.

In this example, the electrode 868 is included in the VSS wiring layer 801 (see FIG. 13) for transmitting the cathode power supply potential VSS. The electrode 868 is connected to the electrode 866B via a contact hole of the flattening film 867.

The laminated structure from the electrode 862 to the electrode 868 constitutes the additional capacitance Cadd. The connected electrodes 862, 864A and 866A constitute one capacitance electrode of the additional capacitance Cadd. This capacitance electrode is composed of electrodes of three conductor layers. The electrode 862 is connected to an output (scanning line) of the output buffer. The connected electrodes 864B and 866B and 868 constitute the other capacitance electrode of the additional capacitance Cadd. This capacitance electrode is composed of electrodes of three conductor layers.

An insulator part among these electrodes constitutes an insulator part of the additional capacitance Cadd. By configuring the additional capacitance Cadd by the capacitance electrode including the electrodes of a plurality of conductor layers connected to one another and the insulator layers between the conductive layers, a large capacitance value can be realized in a small area. It should be noted that the capacitance electrode can be composed of electrodes of three or more layers. Each capacitance electrode may be composed of an electrode of one conductor layer. The numbers of layers of the electrodes respectively constituting two capacitance electrodes may be different, wherein one capacitance electrode may be composed of electrodes of a plurality of conductor layers and the other may be composed of an electrode of one conductor layer.

An insulator layer 869 included in an insulating pixel defining layer (PDL) for separating the OLED element is formed to cover the electrode 868. The insulator layer 869 is, for example, formed of an organic material.

The sealing structure 200 (see FIG. 1) is formed on the insulator layer 869. The sealing structure 200 includes an inorganic insulator layer 870, an organic flattening film 871 and an inorganic insulator (e.g. SiNx, AlOx) layer 872 from below. Each of the inorganic insulator layers 870 and 872 is a passivation layer for improving reliability.

A touch screen film 873, a λ/4 plate 874, a polarizer 875 and a resin cover lens 876 are laminated from below on the sealing structure 200. The λ/4 plate 874 and the polarizer 875 suppress the reflection of light incident from outside. It should be noted that the laminated structure of the OLED display device described with reference to FIG. 14 is an example and some of the layers shown in FIG. 14 may be omitted or layer(s) not shown in FIG. 14 may be added.

As set forth above, embodiments of this disclosure have been described; however, this disclosure is not limited to the foregoing embodiments. Those skilled in the art can easily modify, add, or convert each element in the foregoing embodiments within the scope of this disclosure. A part of the configuration of one embodiment can be replaced with a configuration of another embodiment or a configuration of an embodiment can be incorporated into a configuration of another embodiment.

What is claimed is:

1. A display device, comprising:

a display region including a plurality of pixel circuits; and a driver for outputting a control signal to the plurality of pixel circuits, wherein:

the display region includes a first region and a second region having a lower pixel circuit density than the first region, the driver includes a plurality of output buffers, each of the plurality of output buffers simultaneously outputs the control signal to the plurality of pixel circuits, the plurality of output buffers include a first output buffer and a second output buffer, the number of the pixel circuits as output destinations of the control signal of the first output buffer is larger than the number of the pixel circuits as output destinations of the control signal of the second output buffer, a channel width of a drive transistor of the first output buffer is larger than that of a drive transistor of the second output buffer, the plurality of output buffers further include a third output buffer, the number of the pixel circuits as output destinations of a control signal of the third output buffer is smaller than the number of the pixel circuits as the output destinations of the control signal of the second output buffer, a channel width of a drive transistor of the third output buffer is smaller than that of the drive transistor of the second output buffer, the first output buffer controls the pixel circuits in the first region connected to control lines passing through the first region without passing through the second region, the second output buffer controls the pixel circuits in the first region and the pixel circuits in the second region connected to control lines passing through the first region and the second region, the third output buffer controls the pixel circuits in the first region connected to control lines passing through the first region and the second region, the display device further comprising:

a first additional capacitance connected to an output of the second output buffer, the first additional capacitance reducing a difference between a delay of the control signal of the first output buffer and a delay of the control signal from the second output buffer; and a second additional capacitance having a larger capacitance value than the first additional capacitance connected to the output of the second output buffer, the second additional capacitance being connected to an output of the third output buffer, the first additional capacitance is arranged in a region between the second output buffer and the display region, and the second additional capacitance is arranged in a region between the third output buffer and the display region.

2. The display device according to claim 1, wherein:

the plurality of output buffers output control signals for controlling transistors for writing data signals in retention capacitances in the pixel circuits.

3. The display device according to claim 1, wherein:

a delay of the control signal from the first output buffer, a delay of the control signal from the second output buffer and a delay of the control signal from the third output buffer are equal.

4. The display device according to claim 1, wherein:

the drive transistor of the first output buffer, the drive transistor of the second output buffer and the drive transistor of the third output buffer have the same structure except widths of semiconductor films specifying the channel widths.

5. The display device according to claim 1, wherein:

each of the first additional capacitance and the second additional capacitance includes two capacitance electrodes each including electrodes of a plurality of connected conductor layers, and an insulator between the plurality of conductor layers.

6. A display device, comprising:

a display region including a plurality of pixel circuits; and a driver for outputting a control signal to the plurality of pixel circuits, wherein:

the display region includes a first region and a second region having a lower pixel circuit density than the first region, the driver includes a plurality of output buffers, each of the plurality of output buffers simultaneously outputs the control signal to the plurality of pixel circuits, the plurality of output buffers include a first output buffer and a second output buffer, the number of the pixel circuits as output destinations of the control signal of the first output buffer is larger than the number of the pixel circuits as output destinations of the control signal of the second output buffer, a channel width of a drive transistor of the first output buffer is larger than that of a drive transistor of the second output buffer, the plurality of output buffers further include a third output buffer, the number of the pixel circuits as output destinations of a control signal of the third output buffer is smaller than the number of the pixel circuits as the output destinations of the control signal of the second output buffer, a channel width of a drive transistor of the third output buffer is smaller than that of the drive transistor of the second output buffer, the first output buffer controls the pixel circuits in the first region connected to control lines passing through the first region without passing through the second region, the second output buffer controls the pixel circuits in the first region and the pixel circuits in the second region connected to control lines passing through the first region and the second region, the third output buffer controls the pixel circuits in the first region connected to control lines passing through the first region and the second region, the display device further comprising:

a first additional capacitance connected to an output of the second output buffer, the first additional capacitance reducing a difference between a delay of the control signal of the first output buffer and a delay of the control signal from the second output buffer; and a second additional capacitance having a larger capacitance value than the first additional capacitance connected to the output of the second output buffer, the second additional capacitance being connected to an output of the third output buffer, the first additional capacitance and the second additional capacitance are arranged outside the display region, each of the first additional capacitance and the second additional capacitance includes two capacitance electrodes each including electrodes of a plurality of connected conductor layers, and an insulator between the plurality of conductor layers, and the conductor layers including the electrodes included in the two capacitance electrodes include gate electrodes, source/drain electrodes and another conductor layer in the display region.

7. The display device according to claim 6, wherein, the plurality of output buffers output control signals for controlling transistors for writing data signals in retention capacitances in the pixel circuits.

8. The display device according to claim 6, wherein, a delay of the control signal from the first output buffer, a delay of the control signal from the second output buffer and a delay of the control signal from the third output buffer are equal.

9. The display device according to claim 6, wherein, the drive transistor of the first output buffer, the drive transistor of the second output buffer and the drive transistor of the third output buffer have the same structure except widths of semiconductor films specifying the channel widths.

* * * * *